United States Patent [19]

Moser

[11] 4,175,494

[45] Nov. 27, 1979

[54] FLUID PRESSURE ACTUATOR INTERCONNECTED BOGIES

[75] Inventor: Peter Moser, Dietlikon, Switzerland

[73] Assignee: Schweizerische Lokomotiv-und Maschinenfabrik, Winterthur, Switzerland

[21] Appl. No.: 596,836

[22] Filed: Jul. 17, 1975

[30] Foreign Application Priority Data

Jul. 25, 1974 [CH] Switzerland ..... 10261/74

[51] Int. Cl.[2] ..... B61F 3/08; B61F 5/22; B61F 5/38; B61F 5/50

[52] U.S. Cl. ..... 105/176; 105/168; 105/175 A; 105/199 F

[58] Field of Search ..... 105/165, 175 A, 176, 105/199 A, 199 F, 199 R, 192, 164, 168

[56] References Cited

U.S. PATENT DOCUMENTS

| | | | |
|---|---|---|---|
| Re. 28,815 | 5/1976 | Schmiterlow | 105/199 F |
| 1,546,017 | 7/1925 | Herr | 105/165 X |
| 2,040,262 | 5/1936 | Kruckenberg et al. | 105/175 A |
| 2,099,361 | 11/1937 | Hamilton et al. | 105/175 X |
| 2,241,757 | 5/1941 | Baade | 105/192 |
| 3,696,757 | 10/1972 | Newman et al. | 105/176 |
| 3,828,692 | 9/1974 | Kreissig | 105/199 F |
| 3,835,787 | 9/1974 | Marta et al. | 105/176 |
| 3,854,420 | 12/1974 | Hinnen et al. | 105/176 |
| 3,868,910 | 3/1975 | Schultz | 105/164 |
| 3,911,830 | 10/1975 | Adams | 105/176 |

FOREIGN PATENT DOCUMENTS

| | | | |
|---|---|---|---|
| 876249 | 5/1953 | Fed. Rep. of Germany | 105/176 |
| 2123876 | 11/1972 | Fed. Rep. of Germany | 105/176 |

*Primary Examiner*—Stephen G. Kunin
*Assistant Examiner*—Howard Beltran
*Attorney, Agent, or Firm*—Kenyon & Kenyon

[57] ABSTRACT

The bogies are connected together via fluid pressure operated reciprocating actuators and pressure lines in order to have the trailing bogie carry out complementary lateral movements to the lead bogie. The actuators each have a longitudinal axis directed at a downwardly inclined angle relative to the central vertical plane of the vehicle and bogies and are each mounted for universal movement on a respective bogie as well as on the vehicle body or a middle bogie.

13 Claims, 8 Drawing Figures

FLUID PRESSURE ACTUATOR INTERCONNECTED BOGIES

This invention relates to a rail vehicle having interconnected bogies.

Heretofore, rail vehicles which have been supported by two or more bogies have utilized various types of systems to interconnect the lead and trailing bogies in order to have the trailing bogie carry out a complementary lateral movement to the lead bogie, for example when rounding a curve. In some instances, use has been made of a transverse coupling comprised of two pairs of substantially transversely disposed fluid pressure operated reciprocating actuators to couple the bogies together. These actuators have generally been connected to the proximal ends of the bogies, i.e. to the end of one bogie facing the other bogie, as well as to the vehicle body or a third bogie while permitting the bogies to rotate about respective vertical axes. Pressure lines have also been used to interconnect the cylinder chambers of the actuators so that a movement of one bogie in one direction of rotation causes a movement of the other bogie in the opposite direction of rotation. Rail vehicles of this type, such as described in U.S. Pat. No. 3,854,420, have generally had the reciprocating actuators disposed horizontally. However, such systems have, in some instances, not been able to impart reliable stability to the vehicle and, in some instances, have been relatively cumbersome and complex in construction.

Accordingly, it is an object of the invention to provide a very simple and relatively small construction for a rail vehicle having a transverse coupling system between two or more bogies.

It is another object of the invention to improve the transmission of transverse forces operative between two bogies of a rail vehicle support system.

It is another object of the invention to improve the stability of rail vehicles.

Briefly, the invention provides a rail vehicle having two or more bogies with a coupling means to couple the lead and trailing bogies together wherein use is made of fluid pressure operated reciprocating actuators which are mounted on inclined longitudinal axis and which are mounted for universal movement at either end.

The coupling means includes two pairs of the actuators with each actuator of each pair having a longitudinal axis extending downwardly at an inclined angle relative to a longitudinal central plane through a respective bogie. Each of these actuators is also pivotally connected at one end to a proximal end of a respective bogie and at an opposite end to a body so as to rotate in a universal manner at each end. Each actuator includes a pair of chambers for receiving fluid and a piston slidably mounted between the chambers. Also, pressure lines are connected to each of the chambers to interconnect the actuators whereby a rotary movement of one bogie in one direction causes a rotary movement of the other bogie in an opposite direction.

The coupling means is such that the transverse forces operative between the bogies produce imaginary horizontal component forces which do not need to act directly on the bogie by mechanical means. Further, the height at which these transverse forces act can be freely chosen within the limits imposed by the vehicle dimensions.

So that unwanted vertical forces and movements are not transmitted between the lead and trailing bogies, use is made of a U-shaped member which is pivotally mounted on an end of each of the two bogies about a horizontal axis extending transversely of the longitudinal axis of a bogie. Each of these members has a respective pair of the actuators pivotally secured thereon. Each member is also suspended from or mounted on the vehicle body or a third middle bogie as to be movable so that the forces to be introduced via the coupling can be transmitted independently of the dead-weight of the member and substantially without disturbance.

The coupling means can provide a statically ideal transmission of transverse forces if the longitudinal axes of the reciprocating actuators include, as considered lengthways of the vehicle, an angle whose imaginary vertex is disposed substantially at railtop height. In this case, it is advantageous so far as the stability and quietness of the vehicle are concerned if the angle vertex is disposed substantially centrally between the coupled bogie ends.

Very accurate and substantially immediate transmission of transverse forces can be provided in an embodiment of the invention using double-acting reciprocating actuators if the pressure lines each interconnect those two cylinder chambers of one actuator pair which face in the same transverse direction and if such lines connect these chambers to those two cylinder chambers of the other reciprocator pair which face in the opposite transverse direction.

So that the forces arising in the event of considerable lateral deflections of the leading bogie can be introduced smoothly into the trailing bogie—i.e., so that the trailing bogie may be adjusted appropriately, thus, ensuring very quiet travel of the vehicle in a very simple manner—each of the two actuator pairs can be connected via the pressure lines to one of two additional auxiliary reciprocating actuators whose moving parts e.g. pistons are coupled together by a spring element which becomes resilient when a predetermined adjusting force is exceeded. The pressure lines in this case connect those two cylinder chambers of the particular actuator pair respectively which face in the same transverse direction to a cylinder chamber of the cooperating auxiliary reciprocating actuator that a pressure load exceeding the predetermined adjusting force in the auxiliary cylinder chamber connected to the pressurized cylinder chambers of one actuator pair produces a pressure loading, greater by the restorting force of the resilient spring element, in the pressure-side cylinder chambers of the other actuator pair and vice versa. In this case, according to a very convenient form for ensuring automatic and substantially immediate transmission of the forces to be introduced, those cylinder chambers of the two auxiliary actuator units which are each associated with the same direction of movement of the moving parts are interconnected; and the cylinders of the two actuators have stops or abutments for the pistons which limit the stroke of the moving part against the force of the spring element.

These and other objects and advantages of the invention will become more apparent from the following detailed description and appended claims taken in conjunction with the attached drawings in which:

Like elements have like references throughout the drawings.

Figure 1:
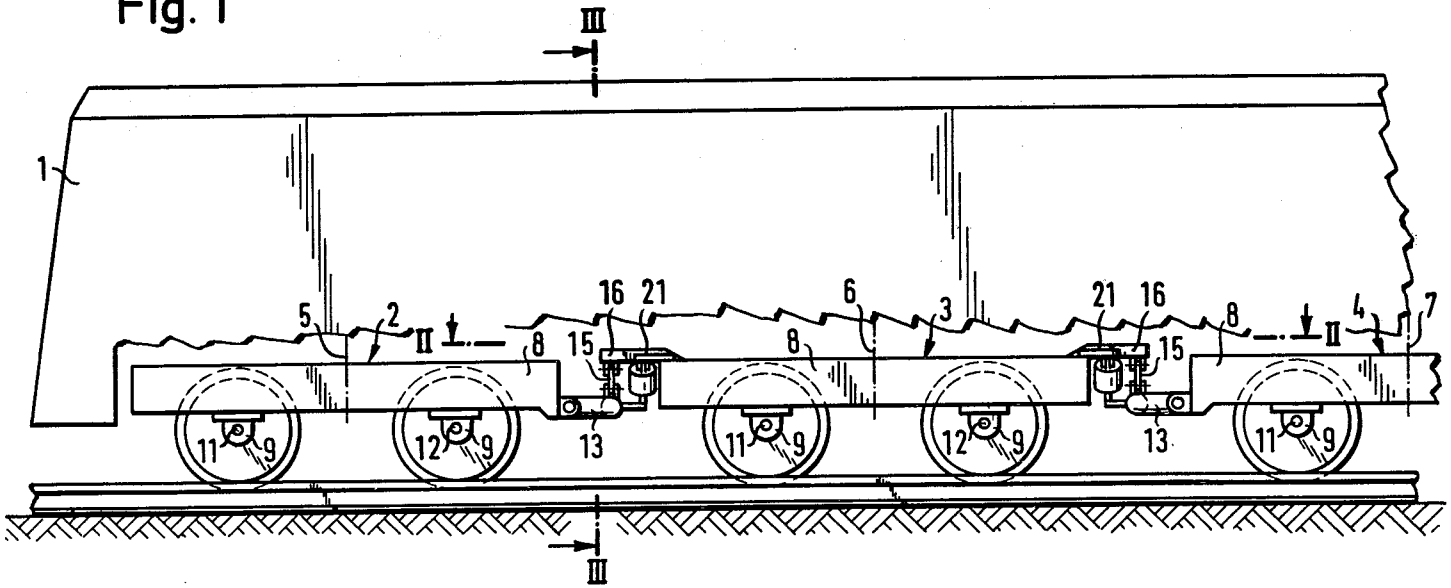
FIG. 1 illustrates a side elevational view showing part of a three-bogie rail vehicle equipped in accordance with the invention.
Figure 2:
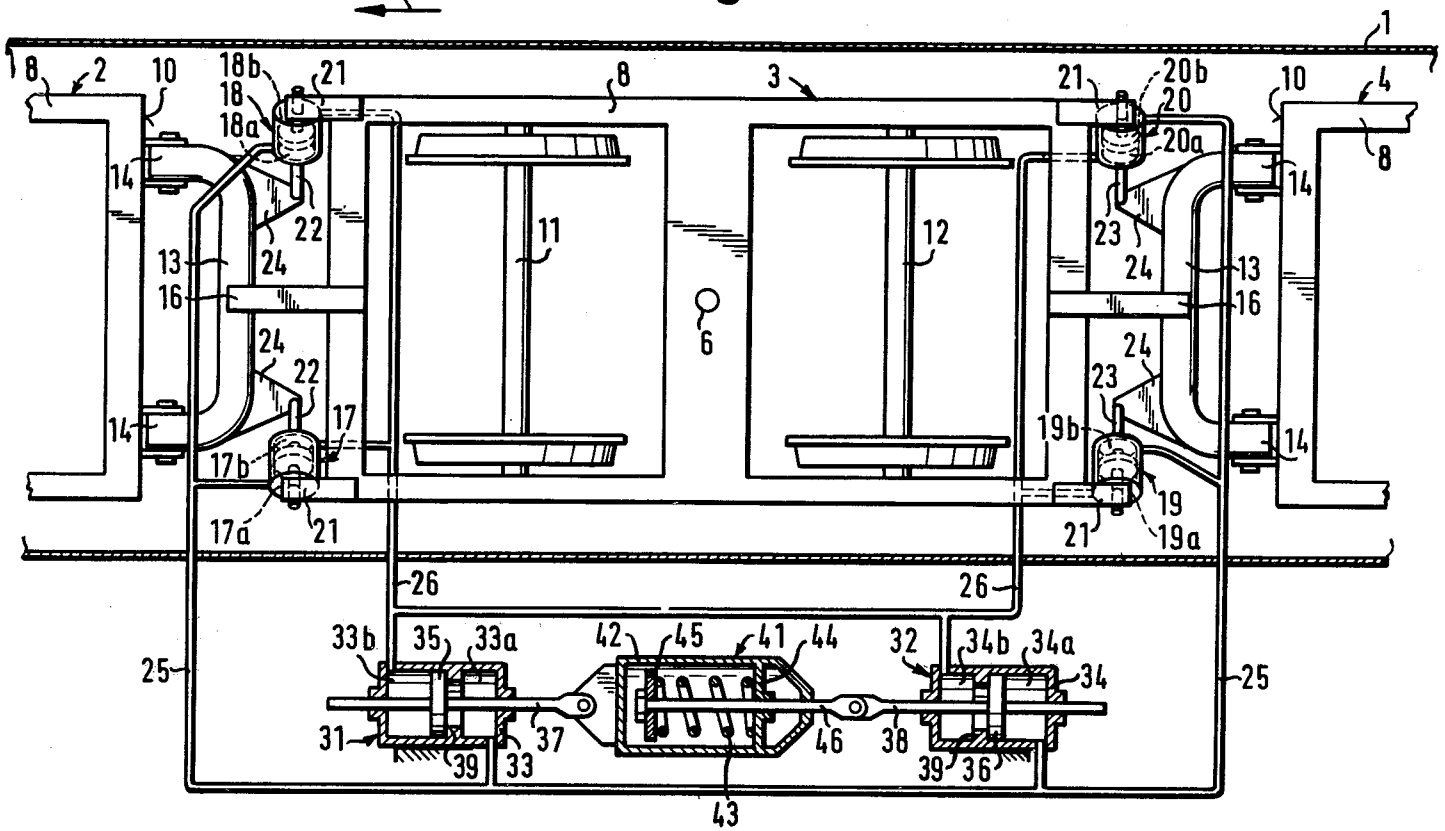
FIG. 2 illustrates a horizontal sectional view taken on line II—II of FIG. 1.
Figure 3:
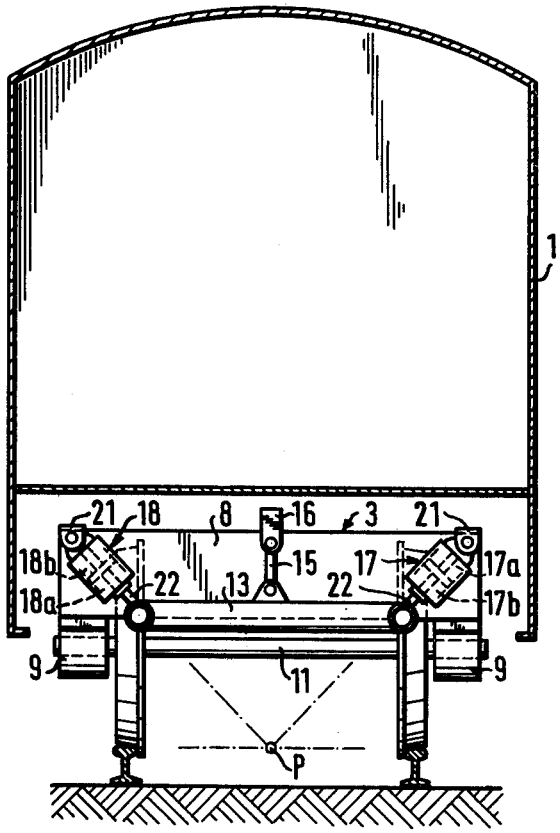
FIG. 3 illustrates a cross-sectional view taken on line III—III of FIG. 1.

Referring to FIGS. 1 to 3, the rail vehicle includes a vehicle body 1 borne by means of spring suspensions (not shown) on three bogies 2, 3, 4 each of which is rotatable relative to the body 1 round a vertical axis 5, 6, 7, respectively. Each bogie 2, 3, 4 has a frame 8 which is resiliently mounted through the agency of bearings 9 on two axles 11, 12.

Disposed at each of the proximal ends 10 of the outer bogies 2 and 4, i.e. the lead and trailing bogies, is a substantially U-shaped member 13 which is tubular in cross-section and whose ends 14 are pivotable around a substantially horizontal axis extending transversely to the longitudinal axis of the particular bogie 2 or 4 concerned. Each member 13 is suspended by a link 15 on a bracket 16 secured to the central bogie 3. The links 15 are so mounted by means of ball joints on the integers 13 and 16 as to be pivotable in all directions, i.e. universally.

The two outer bogies 2, 4 are interconnected by a transverse coupling means comprising two pairs of double-acting hydraulic reciprocating actuators 17, 18 and 19, 20, with each pair being associated with a respective one of the bogies 2 and 4. The actuators 17–18 and 19–20 are so disposed in a transverse and substantially vertical plane as each to incline downwardly toward the longitudinal center vertical plane of the associated bogie 2 or 4. The hypothetical extensions of the longitudinal axes of these actuators 17–20 converge to an imaginary vertex disposed at rail-top height in the longitudinal center plane, point P in FIG. 3, during straight-ahead travel.

The actuators 17–18 and 19–20 each have cylinders which are mounted by means of ball joints in lugs 21 at the four corners of the frame of the central bogie 3. These actuator cylinders receive movable pistons with rods which are guided in the two end members of each cylinder. Through the agency of ball joints the downwardly projecting piston rods 22 and 23 are pivoted in pairs to holders 24 on the associated U-shaped member 13. The ball joint mounting of the actuators 17–20 enables each of them to pivot around a vertical axis and around a substantially horizontal axis so as to be universally mounted.

The two actuator pairs are cross-connected by pressure lines 25, 26. One line 25 connects those cylinder chambers 17*a*, 18*a* of the front actuator pair 17, 18—assuming a direction of travel indicated by an arrow 27 in FIG. 2—which face in the same transverse direction, to those cylinder chambers 19*b*, 20*b* of the rear actuator pair 19, 20 which face in the other transverse direction. The other line 26 connects the corresponding front cylinder chambers 17*b*, 18*b* to the rear cylinder chambers 19*a*, 20*a*.

The two lines 25, 26 are also connected to two additional auxiliary reciprocating actuators 31, 32 which have their cylinders 33, 34 mounted coaxially on the center bogie frame. However, to make the drawing more readily understandable, the actuators 31, 32 are shown in FIG. 2 outside the plan of the vehicle. The cylinders 33, 34 receive pistons 35, 36 which sub-divide the chambers defined by the cylinders 33, 34 and have piston rods 37, 38 each guided in both the end members of the respective cylinders. Those ends of the rods 37, 38 which are near one another are also interconnected by a spring element 41. Abutments 39 in the cylinders 33, 34 limit the operative movements of the cylinders 35, 36 towards the spring element 41.

The spring element 41 comprises a spring cup or cylinder 42, which is articulated to one piston rod 37 and which houses a biased compression spring 43 between an internal wall in the cup 42 and a movable disc or washer or the like 45 in the cup 42. This disc 45 is disposed on a rod 46 which extends through the wall 44 and the end of the cup 42 and is connected to piston rod 38. Consequently, the piston rods 37, 38 are always in tension and the spring force biases the pistons 35, 36 into engagement with abutments 39 within each of the auxiliary actuators 31, 32.

The lines 25 and 26 are interconnected to the sub-chambers 33*a* and 34*a* and 33*b* -34*b* of the two auxiliary actuators 31, 32 which face in the same transverse direction to communicate one with the other and with the associated cylinder chambers of the actuator pairs 17, 18 and 19, 20.

When the vehicle runs in the direction of travel indicated by arrow 27, an e.g. clockwise movement of the lead bogie 2 causes the pistons of the actuators 17, 18 to move in one of the transverse directions, e.g. to the left relatively to arrow 27. Corresponding movements are then made via the pressure lines 25, 26 in the same transverse direction by the pistons of the actuators 19, 20, so that the trailing bogie 4 connected to the actuators 19, 20 makes a counter-clockwise movement. Of course, counter-clockwise rotation of the lead bogi—i.e. when rotating in the opposite direction—causes corresponding movements of the trailing bogie.

Provided that the force causing these movements is equal or less than the biasing of the spring 43, the pistons 35, 36 of the auxiliary actuators 31, 32 remain in the position shown, and the pistons of the actuators 17–20 make operative movements of the same size, assuming identical dimensions. Consequently, any rotation to either side of whichever bogie 2 or 4 is leading causes a corresponding and equal rotation in the opposite direction of whichever bogie 4 or 2 is trailing.

When the force acting on the pistons of the associated actuator pair 17–18 or 19–20 on a curve and in the conditions of movement described is greater than a value depending upon the biasing and/or the characteristics of the spring 43, one or the other of the pistons 35 or 36 disengages from the abutment 39 and compresses the spring 43. The transverse coupling forces which are transmitted are then correspondingly increased by an amount depending upon the characteristics or rate of the spring 43.

In the embodiment described, and assuming that the member 13 is appropriately rigid, a stable transverse coupling is provided in association with an advantageously lightweight construction. The system further takes up little space between the bogies and provides a statically substantially ideal transmission of the forces which arise.

Figure 4:
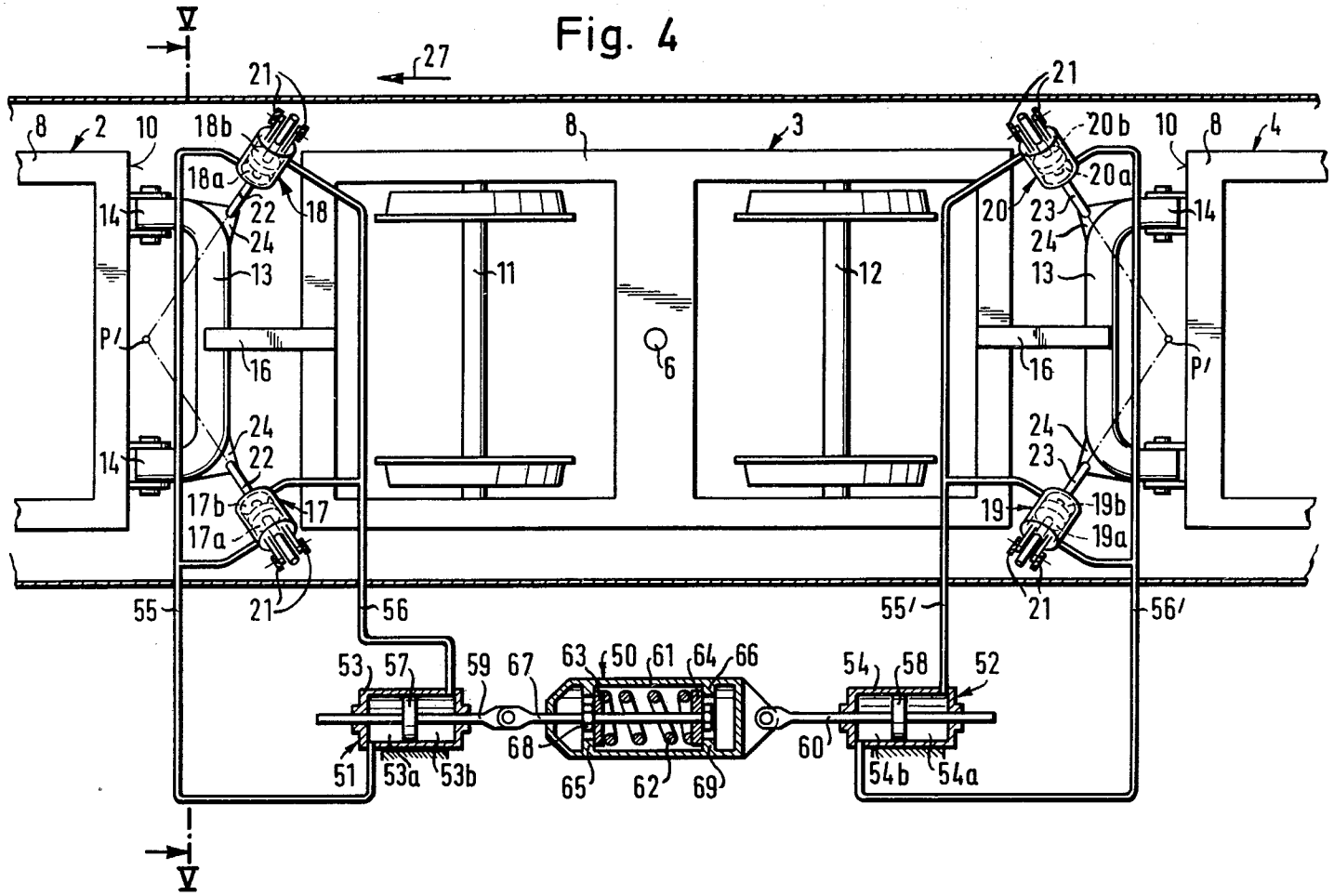
FIG. 4 illustrates a horizontal sectional view corresponding to FIG. 2 of an alternative form of a similar rail vehicle according to the invention.
Figure 5:
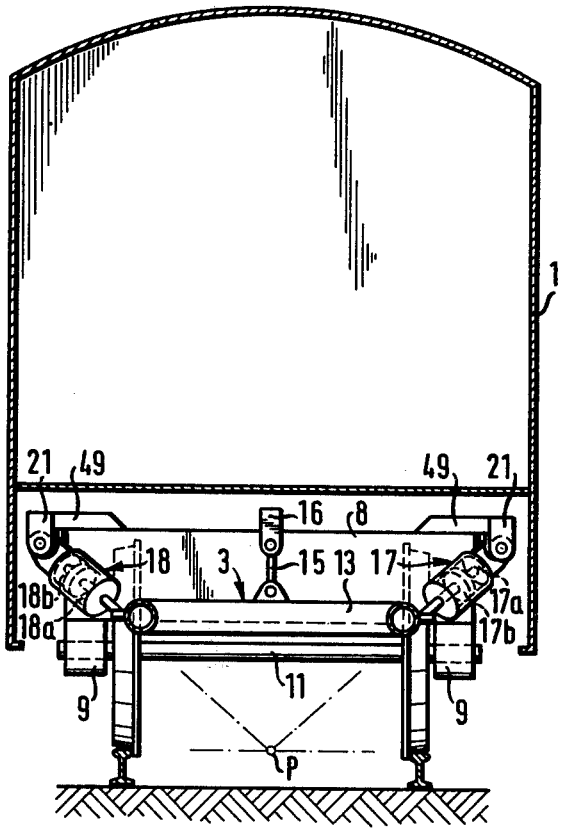
FIG. 5 illustrates a cross-sectional view taken on line V—V of FIG. 4.

The rail vehicle shown in FIGS. 4 and 5 is basically similar to the vehicle shown in FIG. 1–3 except that in the vehicle of FIGS. 4 and 5, the actuators 17, 18 and 19, 20, each of which is at an inclination to the longitudinal center vertical plane of the respective outer bogie 2 or 4, is also at an inclination to the transverse centerplane thereof. Consequently, the intersection points P', visible in FIG. 4, of the hypothetical extensions of the longitudinal axes of the actuators 17–20, and therefore the points of application of the transverse coupling forces to be transmitted, are nearer the outer bogies 2 and 4 than in the previous embodiment. The lugs 21 are secured by means of brackets 49 to the center-bogie frame.

Another difference from the embodiment shown in FIG. 1 and 3 is that the two actuator pairs 17, 18 and 19, 20 are interconnected merely mechanically by way of the spring element 50. The spring element 50 interconnects two additional auxiliary reciprocating actuators 51, 52 disposed on bogie 3 (shown outside the bogie 3 in FIG. 4). Each of these actuators 51, 52 has a cylinder 53, 54 mounted coaxially on the bogie frame which communicate independently via two hydraulic lines 55, 56 and 55', 56' to the adjacent actuator pair 17–18 and 19–20 respectively.

As shown, pistons 57 and 58 subdivide the respective cylinders 53 and 54 into two chambers 53*a*, 53*b* and 54*a*, 54*b* respectively. The furthest-apart chambers 53*a* and 54*a* of the two actuators 51, 52 are each connected by way of pressure line 55 and 55' respectively to the cylinder chambers 17*a*, 18*a* of one actuator pair 17, 18 and the cylinder chambers 19*b*, 20*b* of the other actuator pair 19, 20, respectively. The cylinder chambers 53*b* and 54*b* which are near one another each communicate via pressure line 56 and 56' respectively with the corresponding cylinder chambers 17*b*, 18*b* and 19*a*, 20*a* respectively.

Piston 57 has a piston rod 59 and piston 58 has a piston rod 60. These piston rods 59, 60 are guided in both end members of their respective cylinders and the rod ends near one another are interconnected by the spring element 50 which contains a spring cup 61 pivoted to one piston rod 60 and which receives a compression spring 62 disposed with initial compression between two washers or discs or the like 63, 64. The discs 63, 64 are disposed between two shoulders 65, 66 of the cup 61 and are nonrigidly secured to a rod 67 and each bear against a respective abutment 68, 69 displaceably mounted on the rod 67.

The rod 67 is pivotally connected to the piston rod 59 and the distance between the abutments 68, 69 is adapted to the distance between the shoulders 65, 66. No abutments for the pistons 57, 58 are provided in the cylinders 53, 54.

The system just described operates similarly to the example shown in FIGS. 1–3. For example, assuming that the vehicle is moving in the direction indicated by the arrow 27, rotation of the lead bogie 2 in one direction, e.g. clockwise, causes corresponding piston movements in the front actuator pair 17, 18 and therefore pressurises the members 17*a*, 18*a*. Consequently, the pistons 57, 58 interconnected by the spring element 50 are moved to the right in FIG. 4 in the actuators 51, 52 and the chambers 19*b*, 20*b* of the rear actuator pair are pressurised. Thus, the bogie 4 is rotated correspondingly counter-clockwise and vice versa by way of the pistons of the actuators 19, 20.

The spring element 50 acts as a rigid connection while the force to be transmitted remains equal or less than the initial compression or biasing of the spring 62. When such force exceeds the value corresponding to the biasing of the spring 62, the piston 57 moves further to the right as viewed in FIG. 4 and compresses the spring 62. The spring 62 then imparts a corresponding movement to the piston 58 so that, through the agency of the pistons of the rear actuator pair 19, 20, the trailing bogie 4 experiences a correspondingly increased transverse coupling force which is determined by the characteristics of the spring 62.

Figure 6:
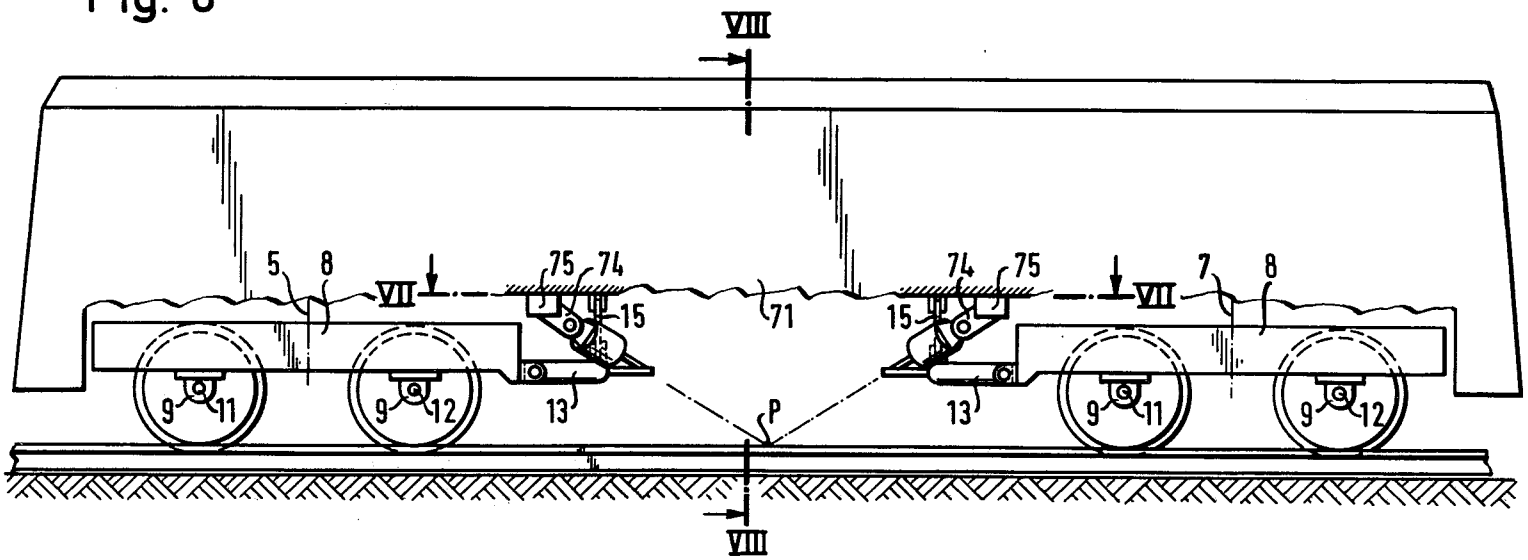
FIG. 6 illustrates a view in side elevation of a two-bogie rail vehicle equipped in accordance with the invention.
Figure 7:
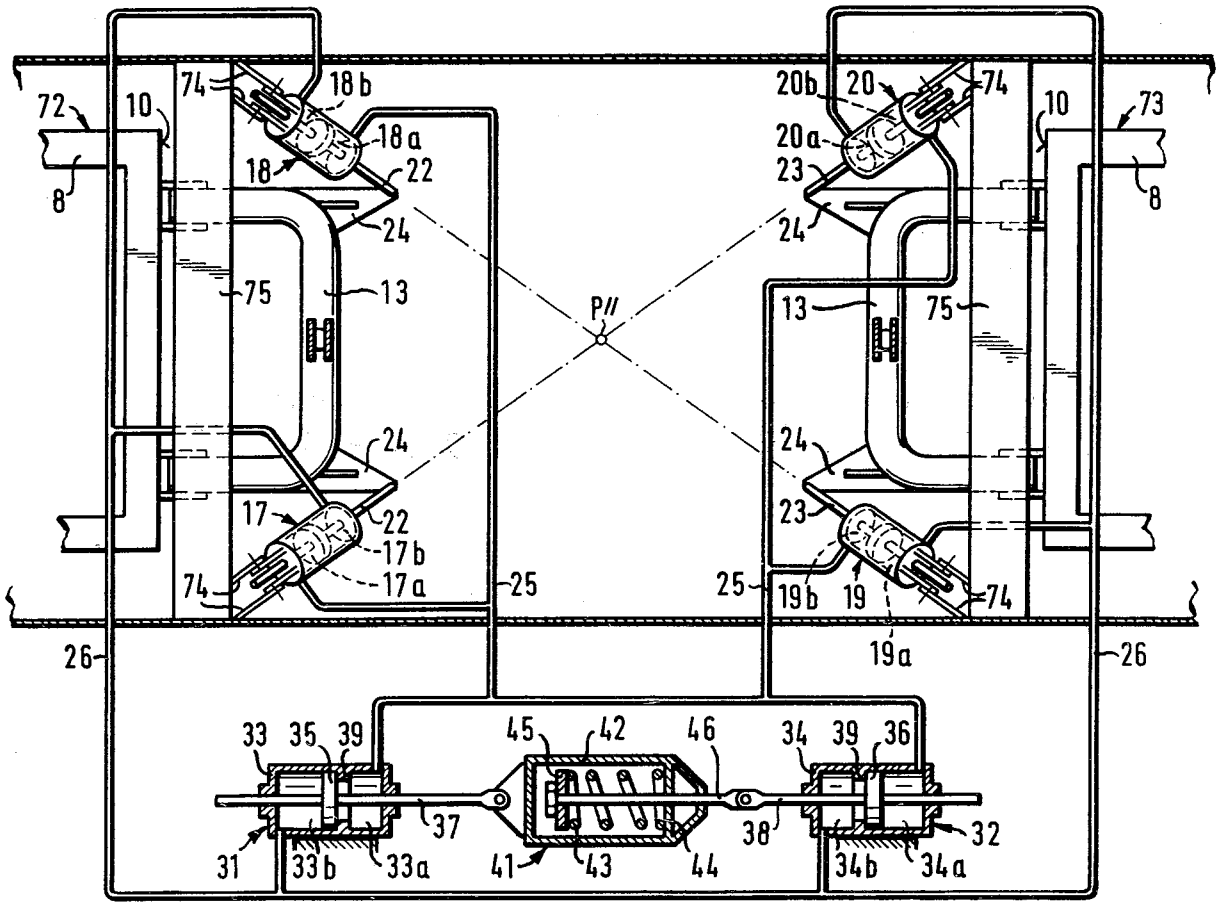
FIG. 7 illustrates a horizontal sectional view taken on line VII—VII of FIG. 6.
Figure 8:
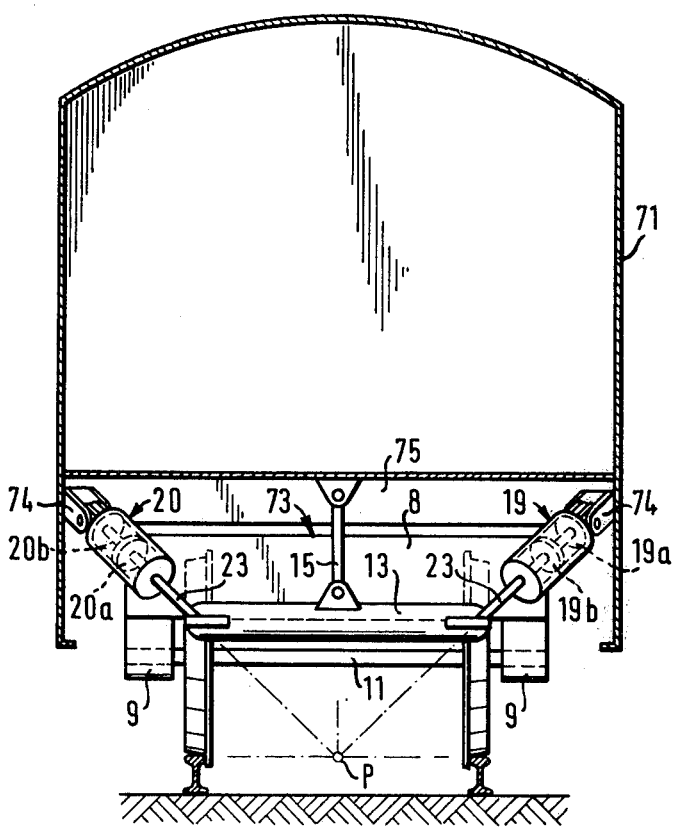
FIG. 8 illustrates a cross-sectional view taken on line VIII—VIII of FIG. 6.

Referring to the rail vehicle shown in FIGS. 6 to 8, the vehicle body 71 is spring mounted on two bogies 72, 73 which are rotatable relative to the body 71 around their vertical axes 5, 7 respectively. The U-shaped members 13 pivoted to the proximal ends 10 of the bogies 72, 73 are so suspended by means of links 15 from the floor of the body 71 as to be pivotable in all directions, i.e. universally.

The reciprocating actuators 17–20 of the transverse coupling are each inclined to the longitudinal centerplane of the corresponding bogies 72 or 73 and to the transverse centerplane of the body 71. In the straight-ahead position, all the hypothetical extensions of the longitudinal axes meet as shown in FIG. 7 at the centerpoint between the bogies 72, 73 at railtop height, such point having the reference P'' (P in FIG. 6).

The cylinders of the actuators 17–18 and 19–20 are mounted by means of ball joints on lugs 74 secured to two cross-bearers 75 of body 71. The piston rods 22, 23 are supported in pairs on the members 13 by way of holders 24.

As in the case of the example shown in FIGS. 1–3, the actuator pairs 17–18 and 19–20 are cross-connected by way of the lines 25, 26 and the additional units 31, 32, line 25 interconnecting cylinder chambers 17*a*, 18*a*, 19*b*, 20*b* and 33*a*, 34*a* while line 26 interconnects cylinder chambers 17*b*, 18*b*, 19*a*, 20*a* and 33*b*, 34*b*.

Consequently, and as in the previous embodiments, rotation of whichever bogie 72 or 73 is the leading bogie in any direction of rotation causes whichever is the trailing bogie 73 or 72 to make an opposite rotation in a corresponding manner; the opposite rotation being equal or greater than the causative rotation in dependence upon the setting of the spring element 41.

This is a very advantageous embodiment since the space between the bogies remains substantially clear and can be used for other necessary fitments. The construction greatly reduces stressing of the various parts of the vehicle since all the motion-producing forces and moments acting via the reciprocating actuators on the vehicle body cancel one another out. Consequently, the vehicle body 71 either experiences no extra loading at all or, in the event of extreme deflections, experiences only slight extra loadings which are virtually negligible so far as vehicle stability is concerned.

There are various possible forms which the coupling means for the bogies may take. For instance, the bogies can be rotatable relative to the vehicle body around a physical spindle or shaft as well as—e.g., in the case of link-suspended bogies—around a hypothetical vertical axis. Pneumatic instead of hydraulic reciprocating actuators can also be used. Also, the hypothetical intersection of the hypothetical extensions of the actuator longitudinal axes can be placed as required, in accordance with the nature of vehicle construction, at any height above or below the railtop and anywhere relatively to the bogies to be coupled together. Another possibility is for the actuator longitudinal axes not to intersect one another but just to cross one another at a distance from one another. The actuators can also be single-acting instead of double-acting.

The actuators can also be directly connected to the bogie ends to be coupled together. The actuators can be arranged the opposite way round, with the piston rods connected to the central bogie or vehicle body and the actuator cylinders connected to the bogie ends to be coupled together and to the spring elements. The U-shaped members can be guided on the central bogie or on the vehicle body in some other way, e.g. by bearing on a bracket.

What is claimed is:

1. A rail vehicle comprising at least two bogies, each having an end proximal to the other and being rotatable about a vertical axis; and a coupling means coupling said two bogies together, said coupling means including two pairs of fluid pressure operated reciprocating actuators, each actuator of each said pair of actuators having a longitudinal axis extending downwardly at an inclined angle toward to a longitudinal central vertical plane through a respective bogies and being positioned on one of respective opposite sides of said plane and pivotally connected at one end to a proximal end of a respective bogie and at an opposite end to a body to rotate in a universal manner, each said actuator including a pair of chambers for receiving fluid and a piston slidably mounted between said chambers, and pressure lines connected to each of said chambers to interconnect said actuators whereby a rotary movement of one of said bogies in one direction causes a rotary movement of the other of said bogies in an opposite direction.

2. A rail vehicle as set forth in claim 1 which further comprises a U-shaped member pivotally mounted on each of said two bogies about a horizontal axis, each respective pairs of actuators being pivotally connected to a respective member.

3. A rail vehicle as set forth in claim 2 which further comprises means connecting each said U-shaped member to said body for relative movement therebetween.

4. A rail vehicle as set forth in claim 1 wherein said axes of said actuators converge to an imaginary vertex disposed at railtop height.

5. A rail vehicle as set forth in claim 4 wherein said vertex is centrally disposed between said bogies.

6. A rail vehicle as set forth in claim 1 wherein said actuators are double-acting reciprocating actuators and said pressure lines include one line interconnecting the chambers of one of said pairs of actuators facing in the same lateral direction with the chambers of the other of said pairs of actuators facing in the opposite lateral direction, and a second line interconnecting the remaining chambers together.

7. A rail vehicle as set forth in claim 1 further comprising two auxiliary reciprocating actuators each having a chamber therein and a reciprocable piston subdividing said chamber, and a spring means connecting said pistons of said auxiliary actuators to each other, said pressure lines connecting opposite sides of said pistons of each said auxiliary actuator to respective chambers of each respective pair of said actuators whereby a pressure load exceeding a preset force in one of said chambers of an auxiliary actuator connected to pressurized chambers of one of said pair of actuators produces a pressure loading in the pressurized chambers of the other of said pairs of actuators in an amount equal to the restoring force of said spring means.

8. A rail vehicle as set forth in claim 7 wherein said chambers of said two actuators disposed in the same direction relative to the direction of travel of said pistons therein are connected to each other, and each of said two actuators includes a stop for limiting the stroke of a respective piston therein against the force of said spring means.

9. A rail vehicle as set forth in claim 1 wherein said body is a third bogie.

10. A rail vehicle as set forth in claim 1 wherein said body is a vehicle body supported on said bogies.

11. A rail vehicle comprising a vehicle body;

three longitudinally spaced bogies for supporting said body, each said bogie being rotatable about a respective vertical axis;

two pairs of fluid pressure operated reciprocating actuators, each actuator of a respective pair of said actuators being universally connected at one end to the middle bogie of said bogies and universally connected at an opposite end to a respective outer bogie of said bogies, each said actuator having a longitudinal axis extending at a downwardly inclined angle toward to a central vertical plane passing through said middle bogie and being positioned on one of respective opposite sides of said plane, each said actuator including a pair of chambers for receiving fluid and a piston slidably mounted between said chambers;

a pair of pressure lines, one of said pressure lines being connected to said chambers of one of said pairs of actuators facing in the same lateral direction and to said chambers of the other of said pairs of actuators facing in the opposite lateral direction, a second of said pressure lines interconnecting the remainder of said chambers;

two auxiliary actuators each including a chamber for receiving fluid, a piston sub-dividing said chamber, each said chamber being connected on opposite sides of said piston to a respective one of said pressure lines;

a spring means connecting said pistons of said auxiliary actuators to each other; and a stop in each chamber of said auxiliary actuators for limiting the stroke of each piston therein against the force of said spring means.

12. A rail vehicle comprising a vehicle body;

three longitudinally spaced bogies for supporting said body, each said bogie being rotatable about a respective vertical axis;

two pairs of fluid pressure operated reciprocating actuators, each actuator of said pairs of actuators being universally connected at one end to said vehicle body and universally connected at an opposite end to a respective outer bogie of said bogies, each said actuator having a longitudinal axis extending at a downwardly inclined angle toward to a central vertical plane passing through said middle bogie and being positioned on one of respective opposite sides of said plane, each said actuator including a pair of chambers for receiving fluid and a piston slidably mounted between said chambers;

two auxiliary actuators each including a chamber for receiving fluid and a piston sub-dividing said chamber;

a pair of pressure lines between each one of said auxiliary actuators and a respective pair of said reciprocating actuators, one of said pressure lines being connected to said chambers of one respective pair of said reciprocating actuators facing in the same lateral direction and to chamber of one auxiliary actuator on one side of said piston therein and the other pressure line of a respective pair of pressure lines being connected to the remaining chambers of said one respective pair of actuators and to said chamber of said one auxiliary actuator on an opposite side of said piston therein;

a spring means connecting said pistons of said auxiliary actuators to each other, and a stop in each chamber of said auxiliary actuators for limiting the stroke of each piston therein against the force of said spring means.

13. A rail vehicle comprising a vehicle body;

a pair of bogies for supporting said body, each said bogie being rotatable about a vertical axis;

two pairs of fluid pressure operated reciprocating actuators, each actuator of a respective pair of said actuators being universally connected at one end to said body and universally connected at an opposite end to a proximal end of a respective bogie, each said actuator having a longitudinal axis extending at a downwardly inclined angle toward to a central vertical plane passing through said middle bogie and being positioned on one of said respective opposite sides of said plane, each said actuator including a pair of chambers for receiving fluid and a piston slidably mounted between said chambers;

a pair of pressure lines, one of said pressure lines being connected to said chambers of one of said pairs of actuators facing in the same lateral direction and to said chambers of the other of said pairs of actuators facing in the opposite lateral direction, a second of said pressure lines interconnecting the remainder of said chambers;

two auxiliary actuators each including a chamber for receiving fluid, a piston sub-dividing said chamber, each said chamber being connected on opposite sides of said piston to a respective one of said pressure lines;

a spring means connecting said pistons of said auxiliary actuators to each other; and a stop in each chamber of said auxiliary actuators for limiting the stroke of each piston therein against the force of said spring means.

* * * * *

UNITED STATES PATENT AND TRADEMARK OFFICE

CERTIFICATE OF CORRECTION

PATENT NO. : 4,175,494

DATED : November 27, 1979

INVENTOR(S) : Peter Moser

It is certified that error appears in the above-identified patent and that said Letters Patent are hereby corrected as shown below:

Column 1, line 44, change "axis" to --axes--
Column 2, line 47, change "restorting" to --restoring--
Column 4, line 43, change "bogi" to --bogie--
Column 7, line 27, after "toward" delete --to--
Column 7, line 28, change "bogies" to --bogie--
Column 8, line 30, after "toward" delete --to--
Column 8, line 65, after "toward" delete --to--
Column 10, line 5, after "toward" delete --to--
Column 10, line 7, after "of" delete --said--

Signed and Sealed this

*Eighteenth* Day of *March 1980*

[SEAL]

*Attest:*

SIDNEY A. DIAMOND

*Attesting Officer*

*Commissioner of Patents and Trademarks*